US005697174A

United States Patent [19]

Gassmann

[11] Patent Number: 5,697,174

[45] Date of Patent: Dec. 16, 1997

[54] MATRIX-ARRAY DISPLAY

[76] Inventor: Gerhard-Günter Gassmann, Vogelsang 5, D-75389 Neuweiler, Germany

[21] Appl. No.: 416,690

[22] PCT Filed: Jul. 14, 1993

[86] PCT No.: PCT/EP93/01854

§ 371 Date: Aug. 2, 1995

§ 102(e) Date: Aug. 2, 1995

[87] PCT Pub. No.: WO94/02927

PCT Pub. Date: Feb. 3, 1994

[30] Foreign Application Priority Data

Jul. 16, 1992 [DE] Germany ..... P 42 23 352.6
Oct. 27, 1992 [DE] Germany ..... 42 36 117.6

[51] Int. Cl.[6] ..... G09F 3/04

[52] U.S. Cl. ..... 40/447; 40/476; 40/508; 340/815.62; 345/108

[58] Field of Search ..... 40/447, 450, 451, 40/472, 476, 508, 513; 340/815.44, 815.62; 345/108, 110, 111

[56] References Cited

U.S. PATENT DOCUMENTS 4,110,922 9/1978 Leemann-Dittmann ..... 40/447
4,733,487 3/1988 Gassmann ..... 40/447 X
4,986,014 1/1991 Gassmann .
5,301,200 4/1994 Killinger .

FOREIGN PATENT DOCUMENTS 0327835 8/1989 European Pat. Off. .
2917394 11/1980 Germany .
3841141 6/1990 Germany .
3934054 7/1990 Germany .
3935771 5/1991 Germany .
4028701 10/1991 Germany ..... 345/108

*Primary Examiner*—Brian K. Green
*Attorney, Agent, or Firm*—Speckman, Pauley & Fejer

[57] ABSTRACT

A matrix-shaped display device with a display foil in which display elements are punched out in the form of tabs. The tabs are positioned in rows and columns, and depending on the desired display, can be positioned by a positioning device in front of or behind a strip having a contrasting color. The display elements are oriented alternately upward and downward from one row to the next. Pairs of oppositely oriented display elements support a strip.

19 Claims, 7 Drawing Sheets

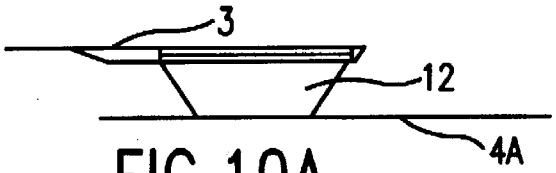
FIG.10A
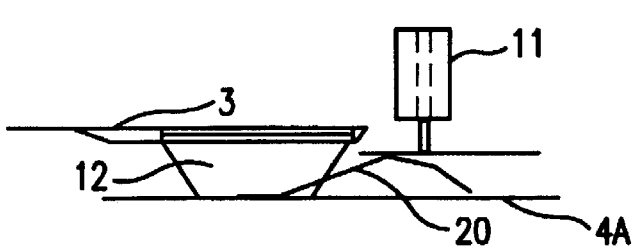
FIG.10C
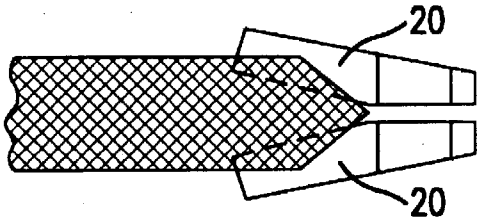
FIG.10B
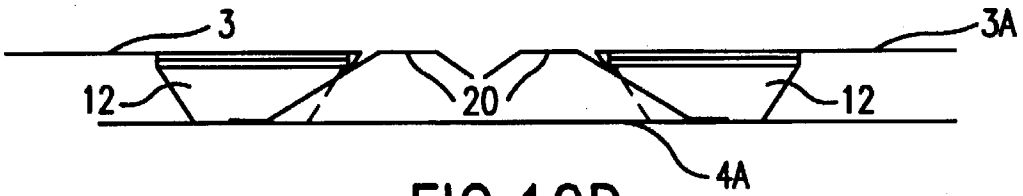
FIG.10D
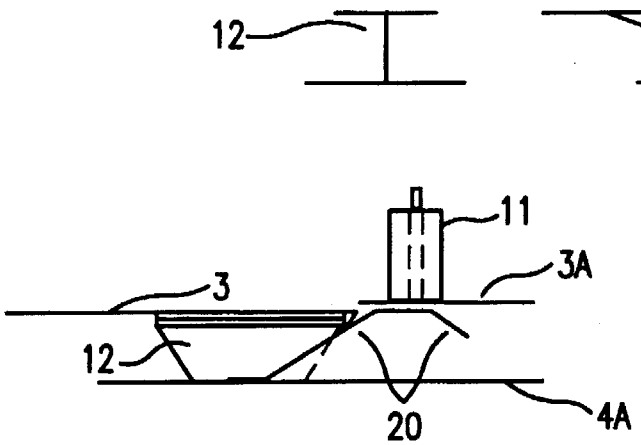

MATRIX-ARRAY DISPLAY

BACKGROUND OF THE INVENTION

Field of the Invention

This invention relates to a matrix-shaped display device having a display foil in which display elements stamped out in the shape of tabs are arranged in columns and lines. The display elements can be brought in front of or behind strips that have a contrasting color, by a setting device in accordance with the desired display. The display elements are alternately directed up and down from line to line and face each other. Pairs of display elements support a strip.

Description of Prior Art

Such a matrix-shaped display device is known from DE 38 03 715 C1. The display foil is a transport belt which runs over two spaced-apart transport rollers. The transport rollers engage rows of transport receivers by catches which act in the areas of the top and bottom edges of the transport belt. The strips are arranged in individual lines behind the display foil, and behind the transport belt. The setting device remains stationary and is disposed in the area of a transport roller. This known display device can be produced in a cost-effective manner, however, it has the disadvantage that the transport receivers in the transport belt are heavily stressed, in particular if large-area displays are involved. Further, the transport receivers can be damaged or destroyed, which limits the service life of the transport belt.

A matrix-shaped display device with a display foil held in a fixed display frame is known from DE 39 34 054 C1. Strips laid out in contrast colors are not used, but instead a cover foil is positioned in front of the display foil. The cover foil and the display foil only perform a small movement relative to each other during setting and cancelling. The setting device moves over the display device and sets the display in columns, wherein the stamped-out cover elements of the cover foil can be respectively brought in front of or behind the associated display element to form the desired display.

This known display device operates considerably more reliably and is simpler in construction, because the display foil and the cover foil practically remain stationary and need not be provided with transport receivers. Instead, the setting device is displaced. However, the relative movement between the display foil and the cover foil causes a new problem. Such relative movement must be extremely accurate and in addition includes not only a back-and-forth movement but also a movement of the entire area of one of these foils directed vertically thereto. The cancellation movement can therefore not be cost-effectively realized.

A matrix-shaped display device is known from DE-OS 29 17 394, which has a movable setting device.

SUMMARY OF THE INVENTION

It is one object of this invention to create a matrix-shaped display device of the type mentioned at the outset which includes the advantages of the two known display devices so that no transport receivers are required in the display foil and that the display can be realized without a cover foil.

In accordance with one preferred embodiment of this invention this object is achieved in a display foil that is held in a stationary display frame. Ends of strips are connected to the setting device which can move over the display foil, and which guides the strips in columns, depending on the desired display, in front of or behind display elements. Other ends of the strips are fastened on a winding roller from which the strips can be rolled off when a display is being set and on which they can be wound again for cancelling the display.

In such embodiment, strips are pulled into or out of the display foil by the setting device or the winding roller. The display foil is stationary and supports, line-by-line, the drawn-in strips in the set display. This is achieved by display elements that are directed against each other. The display device operates reliably and the display foil has a considerably longer service life. The desired display is set by the moving setting device, while resetting by the setting device and cancellation of the display take place by an opposite movement of the winding roller. According to one preferred embodiment of this invention the setting device can be moved across the display foil by an endless transport device and can be reset into the initial position by the driven winding roller. The winding roller is preferably only driven for winding the strips.

So that the strips are unequivocally guided during winding and unwinding on the winding roller or laterally and are not "fouled", one preferred embodiment of this invention provides that the winding roller has spacers between the strips which laterally guide the strips.

Thus, if the setting device is coupled with the endless transport device in a limitedly adjustable manner, so that the setting device is pulled by the strips during resetting, it is assured that the strips are taut during resetting of the setting device and cannot "foul".

In order to provide sufficient space in the setting device for the electromagnets with the setting bolts, one preferred embodiment of this invention provides that the setting device has two vertical rows of electromagnets with setting bolts. The vertical rows are offset by two grid divisions with respect to each other, and one row is assigned to downwardly directed display elements, and the other row is assigned to the upwardly directed display elements of the two columns. In such embodiment the adaptation can be preferably such that both rows of electromagnets have a distance in the line direction which is a multiple of the grid division of the display elements in the line direction. Preferably, the setting device can be moved forward in steps with the grid division, and the display elements of respectively one column can be triggered by the two vertical rows of electromagnets in two chronologically offset steps which can be predetermined by a data processing unit in accordance with the desired display.

According to another preferred embodiment of this invention, a double-sided display is obtained in a simple manner with a setting device having a drawing device disposed on both the front and rear belt of the endless transport device. The setting devices on the front and rear of the display device perform oppositely directed movements, and both setting devices can be controlled simultaneously or individually by the data processing unit.

In accordance with another preferred embodiment a setting device with a drawing device is disposed on the front belt of the endless transport device and is connected by strips with a left winding roller and by additional strips with a right winding roller. Thus, a new display can be set simultaneously with the cancellation of the old display in each displacement direction of the setting device.

To prevent the protrusion of reset display elements on the front of the display foil, one preferred embodiment of this invention provides that a self-adhesive PCV foil is affixed to the back of the stamped display foil and is separated by separating lines in an area of horizontal hinge rods and/or vertical separating bars.

According to another preferred embodiment of this invention, to prevent reset display elements from unintentionally reaching the setting position behind the associated strips, in the area of the setting device the setting bolts of the electromagnets work against springs that are supported on the drawing device. The springs retain the reset display elements in the plane of the display foil.

BRIEF DESCRIPTION OF THE DRAWINGS

The invention will be explained in conjunction with the drawings, wherein:

FIGS. 10A to 10D show views of springs acting upon the display foil and display elements according to another preferred embodiment of this invention.

DESCRIPTION OF PREFERRED EMBODIMENTS

Figure 1:
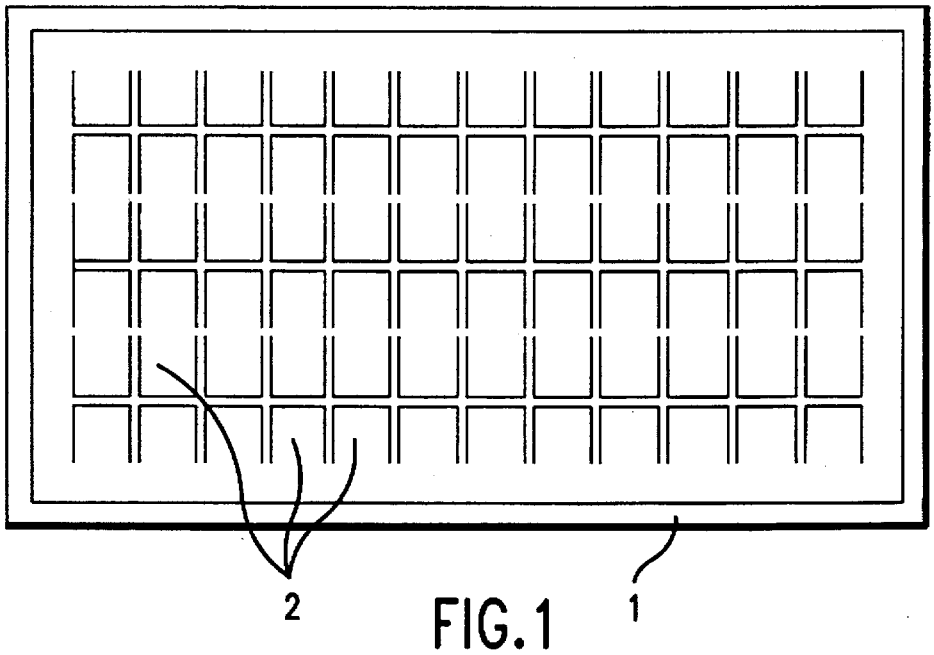
FIG. 1 shows the display device with the display foil clamped into the display frame in a front view, according to one preferred embodiment of this invention.

FIG. 1 shows the display device, according to one preferred embodiment of this invention, from the front without a setting device. A display foil is clamped into a display frame 1 and provides support for display elements 2, which are stamped out in the shape of tabs and are arranged in columns and lines. The display elements 2 change their direction from line to line, so that they are directed downward and then again upward, and thus form a kind of double line. Thus, the display elements 2 are directed against each other and can receive and support a strip in a contrasting color, which is not shown.

Figure 2E:
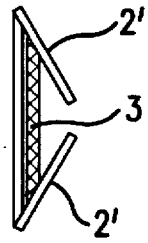
FIGS. 2C–2E show three schematic side views of a strip with set and reset display elements.
Figure 2D:
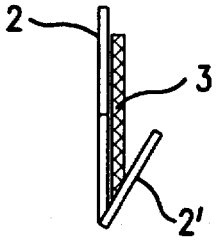
Figure 2C:
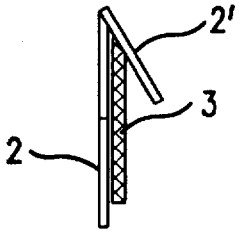
Figure 2A:
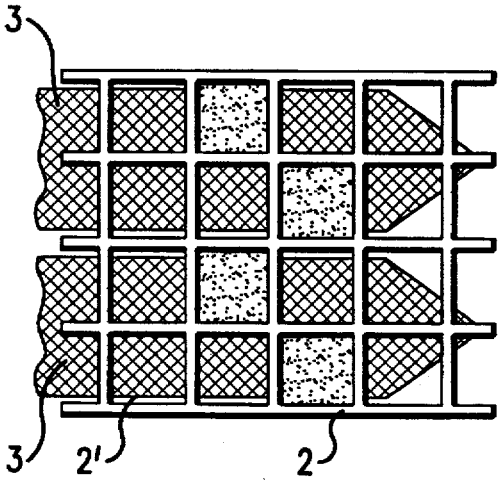
FIG. 2A shows a schematic front view of two strips positioned with respect to set and reset display elements.

In FIG. 2A, two strips 3 have been inserted into partially set display elements 2'. If the display foil is black the display is formed by display elements 2, not shown, while the strips 3 having a contrasting color, are visible in front of the set display elements 2'. This can be seen in views shown in FIGS. 2C–2E in the area of a strip 3 at three subsequent display elements 2. In FIG. 2E both display elements 2' are set and the strip 3 can be seen over both lines. In FIG. 2D only the display element 2' in the lower line has been set, so that the strip 3 is visible only in this area. In FIG. 2C the display element 2' is set in the upper line, so that only the upper portion of the strip 3 is visible.

Figure 2B:
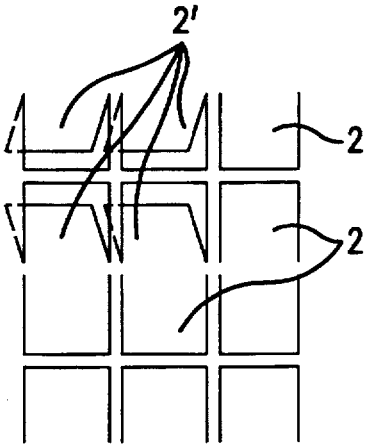
FIG. 2B shows a schematic view of the several set and reset display elements without a strip.

In FIG. 2B four display elements 2' are set in two adjoining lines of the display foil. By the word set, it is meant that the display elements 2' are deflected toward the rear. The display elements 2' form a receptacle in this position into which a strip 3 can be inserted which then fills the windows in the display foil and has contrasting colors with respect to the reset display elements 2.

Figure 3A:
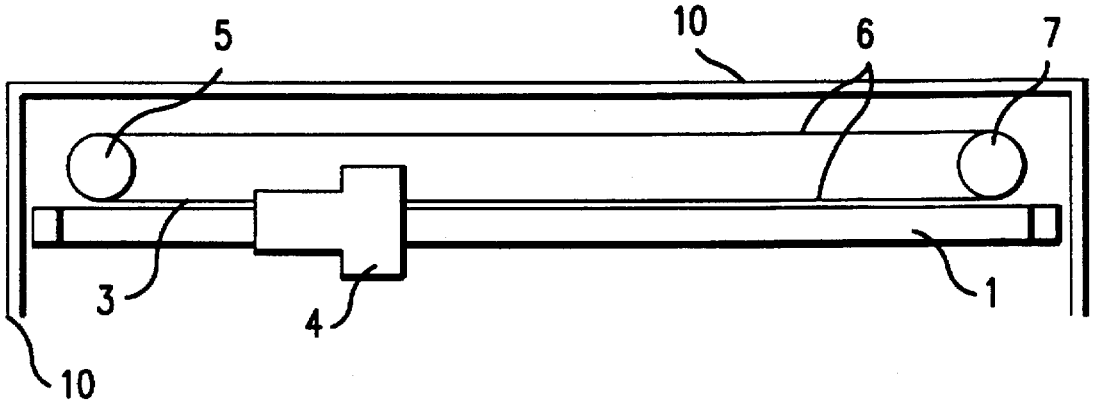
FIG. 3A shows a top view of the display unit without display foil according to another preferred embodiment of this invention.
Figure 3B:
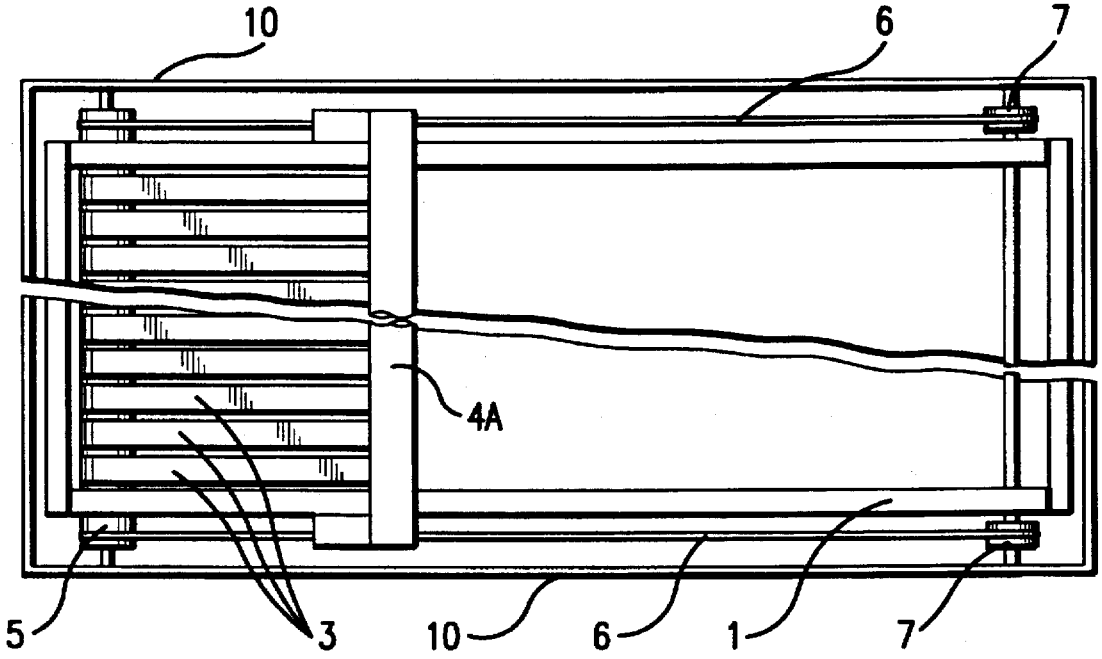
FIG. 3B shows a front view of the display unit shown in FIG. 3A.

A display device with a housing 10 is shown in a top view in FIG. 3A, while FIG. 3B shows a front view thereof. In these views the display foil with the display elements 2 has been omitted and only the display frame 1 is shown. A back-and-forth moving setting device is identified by element reference numeral 4. In the course of a displacement from left to right, the display is set from column to column and the setting device 4 performs the displacement movement. The display is cancelled by a displacement of the setting device 4 from right to left. A winding roller is identified by element reference numeral 5 on which strips 3 having a color that contrasts with the display foil can be wound and unwound. Front ends of the strips 3 are fastened on a drawing device 4A, and rear ends of the strips 3 are fixed on the winding roller 5. Preferably, one strip 3 is provided for each double line of the display foil.

An endless transport device 6 can use chains or toothed belts. The endless transport device 6 is led over the winding roller 5 and a reversing roller 7. The endless transport device 6 displaces the setting device 4 in the course of setting the display, during the displacement of the setting device 4 from left to right. The winding roller 5 is driven in the opposite direction during cancellation and resetting and displacement of the setting device from right to left. In the process, the strips 3 are also displaced in each displacement direction and are appropriately inserted into the rearward deflected display elements 2' during setting of the display.

On the front of the display foil and clamped into the display frame 1, the setting device 4 preferably has setting magnets with setting bolts for each line which deflect or do not deflect the display elements 2 in accordance with the desired display. The strips 3 preferably have points in the displacement direction closely behind the setting bolts of the setting device 4, which are inserted into the just deflected display elements 2'.

Figure 4:
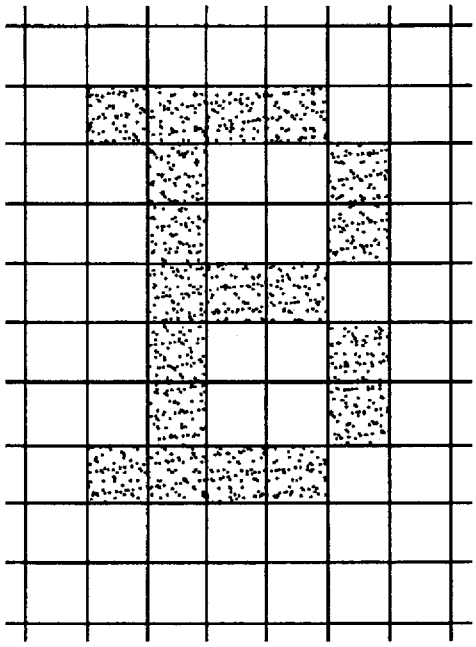
FIG. 4 shows the representation of the letter "B"

The display is preset by a data processing device, so that either the strips 3 or the reset display elements 2 are visible at the appropriate places of the display elements disposed in a matrix shape. Care must be taken that the strips 3 are supported at a sufficient number of places by the display elements 2 of the two associated lines. This condition can be easily met with a word display if "negative writing" is employed, that is, it is not the display elements 2 characterizing the writing that are set, but the display elements 2 of the fields surrounding the words. If, for example, the display foil is black and the strips 3 are white or yellow, with negative writing the words are continuously black and the surrounding field is a white or yellow mosaic, as shown in FIG. 4 by a letter "B". The strips 3 are supported by the set display elements 2' and these by the surroundings present in all representations.

So that the strips 3 can be cleanly wound and unwound on the winding roller 5, the winding roller 5 has spacers between the strips 3 which prevent the strips 3 from "fouling". In addition, it is practical for the setting device 4 not to be fixedly connected with the endless transport device 6 and instead to be urged toward the right by sliding bolts of the endless transport device 6 during setting. This has the advantage that during reverse pulling of the setting device 4 by the winding roller 5 the setting device 4 is pulled by the strips 3 and not by the endless transport device 6.

Figure 5C:
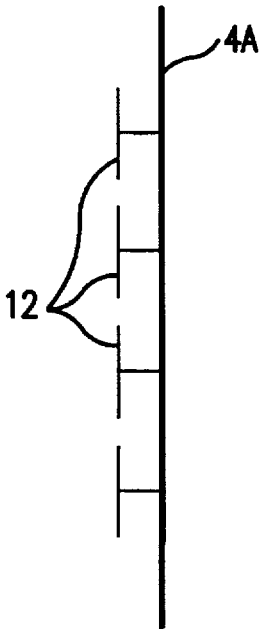
FIG. 5C shows a schematic side view of the setting device shown in FIGS. 5A and 5B.
Figure 5B:
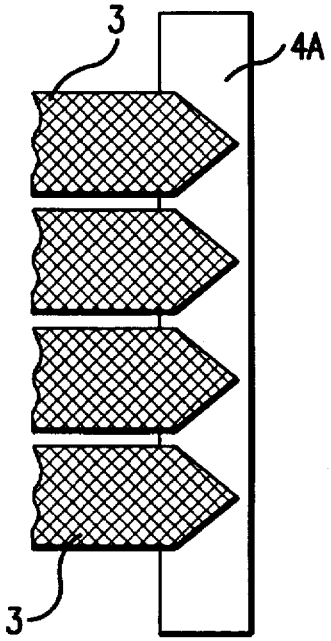
FIG. 5B shows another front view of the setting device shown in FIG. 5A.
Figure 5A:
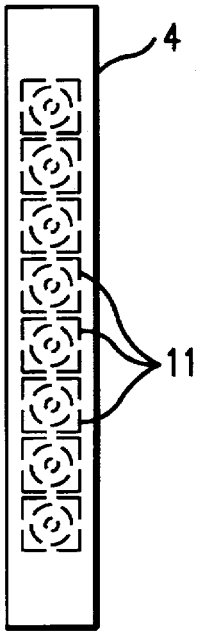
FIG. 5A shows a front view of the setting device having electromagnets according to another preferred embodiment of this invention.

FIGS. 5A to 5C show details of the setting device 4. FIG. 5A shows a front view of the setting device 4 corresponding to the setting device 4 shown in FIG. 3A. Electromagnets 11, positioned under the housing of the setting device 4, has setting bolts oriented in the direction of the display elements 2 of the display foil. Electromagnets 11 are shown in dashed lines in FIG. 5A, since they are hidden by the housing of the setting device 4. The drawing device 4A is disposed behind the display foil and forms one unit with the setting device 4. The drawing device 4A encloses the display foil with the display frame 1 at the top and bottom. FIG. 5B shows the drawing device 4A with the display foil removed. The strips 3 are placed on T-profiles 12 and can be glued or welded thereon. In FIG. 5B the T-profiles 12 are hidden by the strips 3, but are visible in cross section in the view shown in FIG. 5C. The setting device 4 is displaced from column to column of the display elements 2 of the display foil by the drawing device 4A. The data processing device controls the electromagnets 11 in accordance with the desired display.

Figure 6C:
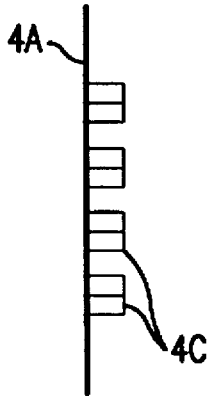
FIG. 6C shows a side view of the drawing device shown in FIG. 6B.
Figure 6B:
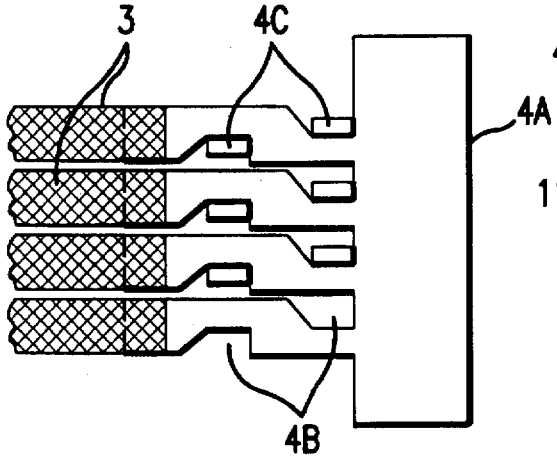
FIG. 6B shows a front view of a drawing device.
Figure 6A:
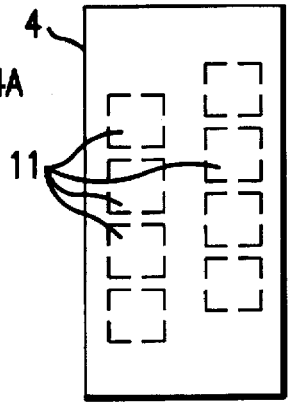
FIG. 6A shows a schematic front view of a setting device with two columns of electromagnets.

FIGS. 6A to 6D show a display device according to another preferred embodiment of this invention having a setting device 4 and a drawing device 4A. If the grid of the display elements 2 in the display foil is smaller than the grid of the electromagnets 11, the electromagnets 11 are disposed in two offset vertical rows as shown in FIG. 6A. The one row of electromagnets 11 is assigned to the downward directed display elements 2 and the other row to the upward directed display elements 2 of the display foil. This requires setting the display elements 2 of a column in two setting steps. The data processing device therefore must divide the "column information" accordingly and correspondingly supply it to the two vertical rows of electromagnets 11 in two steps. According to one preferred embodiment of this invention the distance between the two vertical rows preferably is two grid divisions, so that the vertical rows can be brought to coincide step by step with the display elements 2 of the columns. In a first step the front vertical row of the electromagnets 11 sets the downward directed display elements 2 of the first column and in the second step the downward directed display elements 2 of the second column. In the third step the first vertical row of electromagnets 11 lies above the display elements 2 of the third row, so that the downward directed display elements 2 of this column can be set in the third step. The upward directed display elements 2 of the first column can also be set simultaneously in the third step. Starting with the fourth step, the vertical rows of electromagnets 11 lie over two columns of display elements 2 disposed at a distance of two grid divisions, so that the front vertical row of electromagnets 11 controls the downward directed display elements 2 of the front column, and the back vertical row of electromagnets 11 controls the upward directed display elements 2 of the spaced apart rear column. The cycle of the step movement of the setting device 4 and the drawing device 4A is then set by the grid division.

Recesses 4B can be seen in the drawing device 4A as shown in FIG. 6B. Recesses 4B are associated with the downward and upward directed display elements 2. If a display element 2 is set, the setting bolt of the associated electromagnet 11 pushes the display element 2 into the recess 4B. In the course of continued steps of the drawing device 4A the respective display element 2 is guided by the oblique edge of the recess 4B behind the drawing device 4A. The drawing device 4A comprises a flat sheet metal strip. Only backward bent elements 4C are provided in the recesses 4B in the drawing device 4A, as can be seen in FIG. 6C in a lateral view and in FIG. 6D in a top view.

Figure 6D:
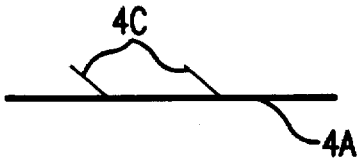
FIG. 6D shows a top view of the drawing device shown in FIG. 6B.

The elements 4C in the recesses 4B have been omitted in the lowermost sheet metal strips of the drawing device 4A shown in FIG. 6B so that their shape can be better recognized. Only the recesses 4B are necessary during setting of the display elements 2 of the display foil disposed in front of the drawing device 4A and the strips 3. During cancellation of the display by the resetting movement of the setting device 4 and the drawing device 4A the bent elements 4C are of importance, because the bent elements 4C guide the set display elements 2' to the front of the drawing device 4A and thus back into the plane of the display foil. The drawing device 4A in accordance with FIGS. 6B to 6D is simpler than the drawing device 4A shown in FIGS. 5A to 5C, and thus can be more easily produced. The elements 4C have been bent back after reaming out the sheet metal strips. The lateral dimensions of the drawing device 4A is increased by the recesses 4B and the elements 4C. However, this is relatively unimportant if the electromagnets 11 are larger than the display elements 2.

Constructing the drawing device 4A from a sheet metal strip is possible, as can be clearly seen in the views of FIGS. 6C and 6D. The drawing device 4A is connected at the top and bottom with the setting device 4, and together they form a unit which encloses the display frame 1 and the clamped-in display foil.

In the display device shown in FIGS. 3A and 3B it is necessary to turn the setting device 4 back toward the left prior to renewed setting. This could be disadvantageous with display devices requiring rapid changes of the display. Furthermore, the message can only be viewed from the front of the display device that is shown in FIGS. 3A and 3B.

Figure 7A:
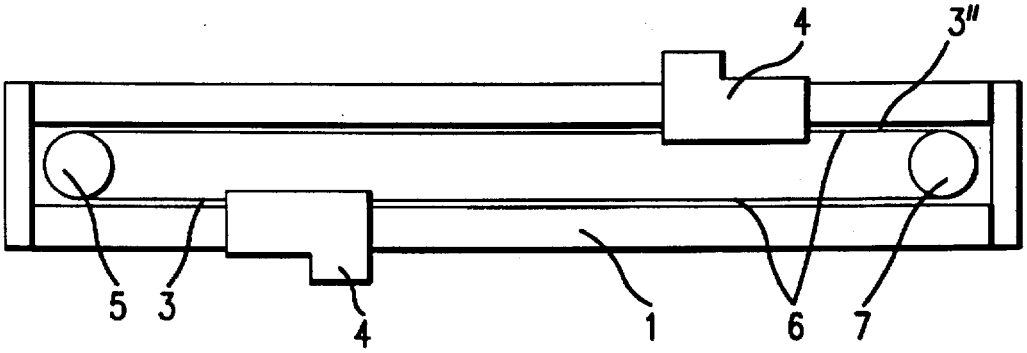
FIG. 7A shows a top view of a display device having a display on the front and rear.
Figure 7B:
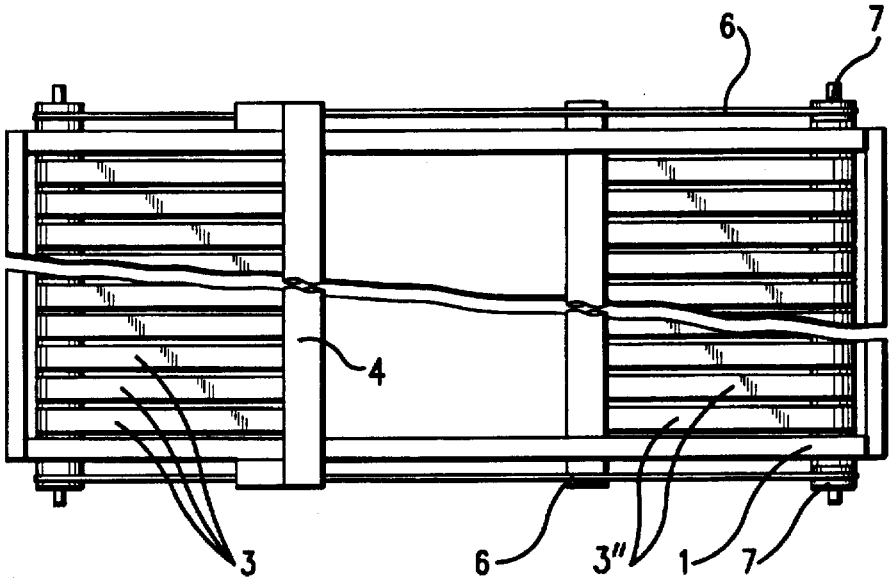
FIG. 7B shows a front view of the display device shown in FIG. 7A.

If, as shown in FIGS. 7A and 7B, a setting device 4 with a drawing device 4A is disposed on both the front and rear belts of the endless transport device 6, the front setting device 4 on the front belt is displaced from left to right and the rear setting device 4 on the rear belt is displaced from right to left. The rear setting device 4 is connected with strips 3" which are wound and unwound on the reversing roller 7 which is a further winding roller, as shown in FIG. 7B. If the same display is shown on the front and back of the display device, the data processing device controls both setting devices 4 in parallel and simultaneously. With an expansion of the data processing unit it is possible to control both setting devices 4 individually but simultaneously. Cancellation of the displays takes place by resetting the endless transport device 6 and the setting devices 4 in the initial position represented.

Figure 8A:
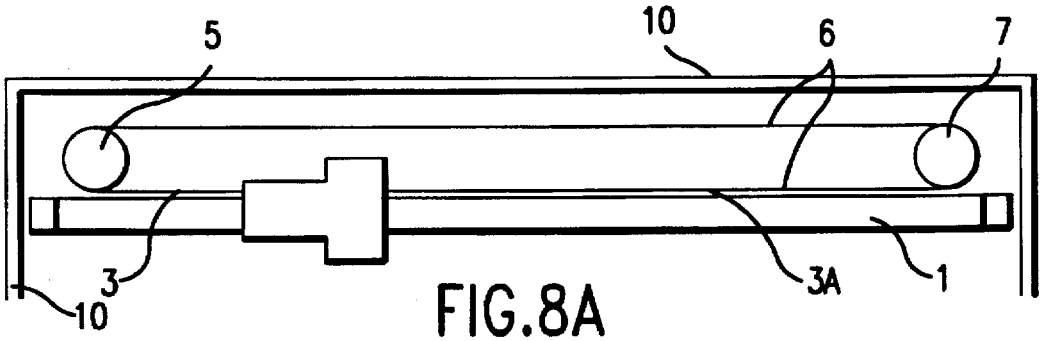
FIGS. 8A and 8B show a display device in a top view and front view, respectively, wherein the old display is cancelled and a new display is set by displacement of the setting device.
Figure 8B:
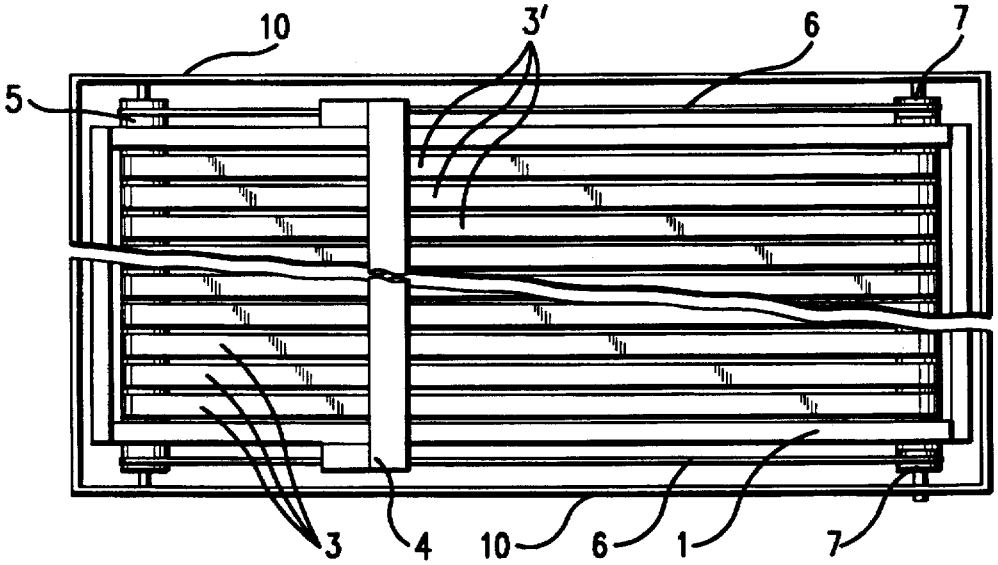

A display device is illustrated in FIGS. 8A and 8B wherein the old display is cancelled and the new display is set, in one movement. For this purpose the display device is provided with the winding roller 5 and the winding roller 7, which are connected by strips 3 or 3' with the setting device 4. Cancellation is performed in front of the setting device 4 and new setting performed behind the setting device 4 independently of the direction of movement of the setting device 4, so that a display change can be performed in any movement direction.

Figure 9D:
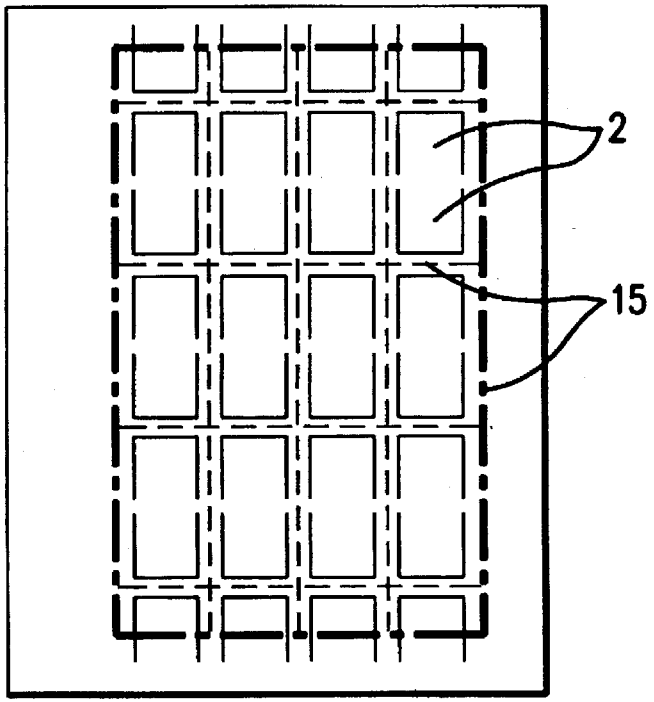
FIG. 9D shows a front view of a display foil having a PVC foil affixed thereto.
Figure 9A:
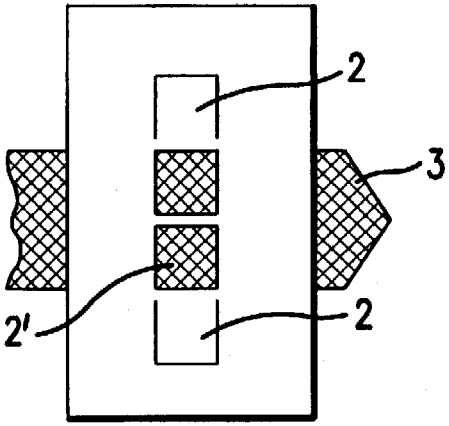
FIG. 9A shows a front view of a strip and several set and reset display elements.
Figure 9B:
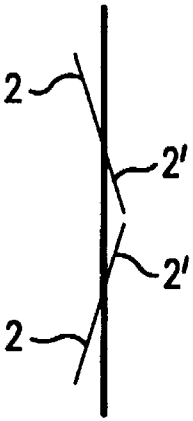
FIG. 9B shows a side view of the strip and display elements shown in FIG. 9A.
Figure 9C:
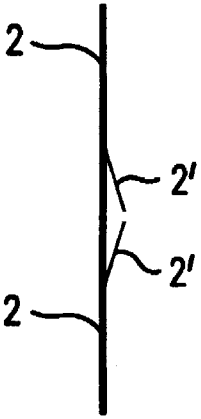
FIG. 9C shows a side view of a strip and display elements according to another preferred embodiment of this invention.

In a display device with display elements 2 directed against each other, it can be troublesome that reset display elements 2 protrude toward the front of the display device. In FIGS. 9A and 9B two display elements 2' directed against each other are set and lie under the strip 3. The display elements 2 adjoining the set display elements 2' in the same column are reset. If the set display elements 2' are greatly deflected out of the plane of the display foil by the strip 3, it is possible that the reset display elements 2 of the column protrude toward the front, as shown in FIG. 9B, because tensions build up in the common hinge shaft of the display elements 2. However, a position of the display elements 2' as shown in FIG. 9C is desired. The reset display elements 2 should remain in the plane of the display foil.

To prevent such undesirable protrusions, a self-adhesive PVC foil is affixed to a previously stamped out display foil constructed from, for example, a Teflon-coated fiberglass fabric. The PVC foil is subsequently separated in the area of the remaining horizontal hinge bars and/or the vertical separating bars as indicated by the separating lines 15 in FIG. 9D. The PVC foil is positioned on the back of the display foil. The display elements 2 can be deflected toward the rear without the adjoining display element 2 yielding toward the front. The adhesive surfaces on the hinge bars and/or separating bars lose their adhesiveness after a few setting operations and do not hinder the insertion of the strips 3.

In accordance with FIGS. 10A to 10D, springs 20 are positioned on the back of a display device, according to one preferred embodiment of this invention, in connection with the drawing device 4A, which press the display foil with the display elements 2 against the setting device 4 disposed on the front of the device. Such springs 20 prevent the display elements 2 which should not be set from being inadvertently displaced behind the strip 3. This could occur if individual display elements 2 are bent or projected away from the back of the display foil.

The cross section of a profile 12 of the drawing device 4A on which the strip 3 is fastened is shown in FIG. 10A. The strip 3 is not welded on, but inserted into a pocket so that the strip 3 can be easily suspended and easily removed. The springs 20 are fastened on the bottom of the drawing device 4A and are shown in FIG. 10B. The display element 2 thus cannot be displaced behind the strip 3 and the profile 12. However, if the setting bolt of the electromagnet 11 presses against the display element 2 of the display foil, the display element 2 is then deflected backward (downward as shown in FIG. 10C) with the spring 20 and the display element 2 is displaced behind the strip 3, as shown in FIG. 10C. The springs 20 are bent so that the display elements 2 are pushed forward during a displacement from left to right as well as during a displacement from right to left and do not get caught on the springs 20.

The springs 20 are disposed in reverse with display devices which can be set in both displacement directions of the setting device 4, and with display devices with two oppositely moving drawing devices 4A.

I claim:

1. In a matrix-shaped display device having a display foil in which a plurality of display elements are stamped out in the shape of tabs and a setting device, the display elements being arranged in columns and rows and capable of being displaced in front of or behind at least one strip by the setting device in accordance with a desired display, the at least one strip having a color that contrasts with a color of the display elements, the display elements alternately directed upward and downward from row to row, and the display elements facing each other in pairs to support the at least one strip, the improvement comprising:

the display foil positioned in a stationary display frame (1), a first end of the at least one strip (3) being mounted on the setting device (4), the setting device (4) guiding the at least one strip (3) in one of in front of and behind each of the display elements (2) depending on the desired display, and a second end of the at least one strip (3) being mounted on a winding roller (5) from which the at least one strip can be rolled off when a display is being set and on which the at least one strip can be wound again when canceling the display.

2. In a matrix-shaped display device in accordance with claim 1, wherein the setting device (4) is moved across the display foil by an endless transport device (6), and the setting device (4) is reset into an initial position by the winding roller (5).

3. In a matrix-shaped display device in accordance with claim 2, wherein the winding roller (5) is driven only for winding the at least one strip (3).

4. In a matrix-shaped display device in accordance with claim 3, wherein the winding roller (5) has a plurality of spacers between at least two strips (3), and the plurality of spacers guide at least two of said strips (3).

5. In a matrix-shaped display device in accordance with claim 4, wherein the setting device (4) is nonfixedly coupled to the endless transport device (6), so that the setting device (4) is pulled by the at least one strip (3) during resetting.

6. In a matrix-shaped display device in accordance with claim 5, wherein the setting device (4) has a plurality of electromagnets (11) arranged in two vertical rows, each electromagnet (11) having a setting bolt, wherein the two vertical rows are offset by two grid divisions of the display elements (2) with respect to each other, and one of the two vertical rows is assigned to a plurality of downwardly directed display elements (2) of a column of display elements (2) and the other of the two vertical rows is assigned to a plurality of upwardly directed display elements (2) of the column of display elements (2).

7. In a matrix-shaped display device in accordance with claim 6, wherein each of the two vertical rows of electromagnets (11) are positioned at a distance from each other in a horizontal row direction, the distance is a multiple of a grid division of the display elements (2) in the horizontal row direction, the setting device (4) is displaced forward in a plurality of steps with the grid division, and each of the display elements (2) in a column are triggered by the two vertical rows of electromagnets (11) in two chronologically offset steps which is predetermined by a data processing unit in accordance with the desired display.

8. In a matrix-shaped display device in accordance with claim 7, wherein a first setting device (4) having a drawing device (4A) is disposed on a front belt of the endless transport device (6), a second setting device (4) having a drawing device (4A) is disposed on a rear belt of the endless transport device (6), the setting devices (4) move in an opposite direction with respect to each other, and the setting devices (4) are controlled one of simultaneously and individually by the data processing unit.

9. In a matrix-shaped display device in accordance with claim 8, wherein in an area of the setting device (4) at least one setting bolt of at least one electromagnet (11) works against a spring (20), the spring (20) is supported on the drawing device (4A), and the spring (20) urges at least one reset display element (2) in a plane of the display foil.

10. In a matrix-shaped display device in accordance with claim 7, wherein the setting device (4) with a drawing device (4A) is disposed on the front belt of the endless transport device (6), the setting device (4) is connected by the at least one strip (3) with the winding roller (5) and the setting device (4) is connected by a second strip (3) with a second winding roller (7).

11. In a matrix-shaped display device in accordance with claim 10, wherein a self-adhesive PVC foil is affixed to the back of the stamped display foil, and the PVC foil is separated by a plurality of separating lines (15) in an area of horizontal hinge rods and vertical separating bars.

12. In a matrix-shaped display device in accordance with claim 11, wherein in an area of the setting device (4) at least one setting bolt of at least one electromagnet (11) works against a spring (20), the spring (20) is supported on the drawing device (4A), and the spring (20) urges at least one reset display element (2) in a plane of the display foil.

13. In a matrix-shaped display device in accordance with claim 2, wherein a first setting device (4) having a drawing device (4A) is disposed on a front belt of the endless transport device (6), a second setting device (4) having a drawing device (4A) is disposed on a rear belt of the endless transport device (6), the setting devices (4) move in an opposite direction with respect to each other, and the setting devices (4) are controlled one of simultaneously and individually by the data processing unit.

14. In a matrix-shaped display device in accordance with claim 2, wherein the setting device (4) with a drawing device (4A) is disposed on a front belt of the endless transport device (6), the setting device (4) is connected by the at least one strip (3) with the winding roller (5) and the setting device (4) is connected by a second strip (3) with a second winding roller (7).

15. In a matrix-shaped display device in accordance with claim 1, wherein the winding roller (5) is driven only for winding the at least one strip (3).

16. In a matrix-shaped display device in accordance with claim 1, wherein the winding roller (5) has a plurality of spacers between at least two strips (3), and the plurality of spacers guide at least two of said strips (3).

17. In a matrix-shaped display device in accordance with claim 1, wherein the setting device (4) is nonfixedly coupled to an endless transport device (6), so that the setting device (4) is pulled by the at least one strip (3) during resetting.

18. In a matrix-shaped display device in accordance with claim 1, wherein the setting device (4) has a plurality of electromagnets (11) arranged in two vertical rows, each electromagnet (11) having a setting bolt, wherein the two vertical rows are offset by two grid divisions of the display elements (2) with respect to each other, and one of the two vertical rows is assigned to a plurality of downwardly directed display elements (2) of a column of display elements (2) and the other of the two vertical rows is assigned to a plurality of upwardly directed display elements (2) of the column of display elements (2).

19. In a matrix-shaped display device in accordance with claim 1, wherein a self-adhesive PVC foil is affixed to the back of the stamped display foil, and the PVC foil is separated by a plurality of separating lines (15) in an area of horizontal hinge rods and vertical separating bars.

* * * * *